US010766280B2

(12) United States Patent
Takeda et al.

(10) Patent No.: US 10,766,280 B2
(45) Date of Patent: Sep. 8, 2020

(54) PRINTER

(71) Applicant: SATO HOLDINGS KABUSHIKI KAISHA, Tokyo (JP)

(72) Inventors: Yasuhide Takeda, Saitama (JP); Hirohito Shimazaki, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/606,312

(22) PCT Filed: Sep. 25, 2018

(86) PCT No.: PCT/JP2018/035513
§ 371 (c)(1),
(2) Date: Oct. 18, 2019

(87) PCT Pub. No.: WO2019/065653
PCT Pub. Date: Apr. 4, 2019

(65) Prior Publication Data

US 2020/0130383 A1 Apr. 30, 2020

(30) Foreign Application Priority Data

Sep. 26, 2017 (JP) ..... 2017-185375

(51) Int. Cl.

| | |
|---|---|
| ***B41J 11/04*** | (2006.01) |
| ***B41J 2/325*** | (2006.01) |
| ***B41J 11/70*** | (2006.01) |
| ***B41J 29/13*** | (2006.01) |
| *B41J 15/04* | (2006.01) |

(52) U.S. Cl.
CPC ..... *B41J 11/04* (2013.01); *B41J 2/325* (2013.01); *B41J 11/70* (2013.01); *B41J 29/13* (2013.01); *B41J 15/04* (2013.01)

(58) Field of Classification Search
CPC ... B41J 11/04; B41J 2/325; B41J 11/70; B41J 29/13; B41J 15/04; B41J 15/16
See application file for complete search history.

(56) References Cited

U.S. PATENT DOCUMENTS

| | | | | |
|---|---|---|---|---|
| 9,718,285 | B2 * | 8/2017 | Kokuta | B41J 15/16 |
| 2006/0088360 | A1 | 4/2006 | Watanabe et al. | |
| 2009/0038495 | A1 | 2/2009 | Butzen et al. | |
| 2017/0080726 | A1 | 3/2017 | Onodera | |

FOREIGN PATENT DOCUMENTS

| | | | |
|---|---|---|---|
| JP | 4-45749 | U | 4/1992 |
| JP | 2006-123271 | A | 5/2006 |
| JP | 2007-172014 | A | 7/2007 |
| JP | 2009-179010 | A | 8/2009 |
| JP | 2015-123625 | A | 7/2015 |

* cited by examiner

*Primary Examiner* — Thinh H Nguyen
(74) *Attorney, Agent, or Firm* — Foley & Lardner LLP

(57) ABSTRACT

A printer includes a casing, a detachable unit provided to the casing, the detachable unit being configured to be detachable from the casing, an adjacent member provided adjacent to the detachable unit, and an engagement member attached to the adjacent member, the engagement member being configured to be changeable between an engagement position with which the adjacent member is engaged with the casing and a non-engagement position with which the adjacent member is removed from the casing. The engagement member engages the detachable unit to the casing together with the adjacent member, at the engagement position.

11 Claims, 7 Drawing Sheets

PRINTER

TECHNICAL FIELD

The present invention relates to a printer.

BACKGROUND ART

JP2009-179010A discloses a thermal printer that includes a ribbon supplying shaft that holds an ink ribbon, in a rolled form, to be supplied to a printing unit and a ribbon roll up shaft that rolls up a used part of the ink ribbon. The printer performs printing by heating the ink ribbon and transferring ink on the ink ribbon onto a print medium. JP2009-179010A discloses a configuration facilitating an exchanging operation for the ink ribbon.

SUMMARY OF INVENTION

Such a printer may be designed so that parts other than the ink ribbon, such as a platen roller, can be exchanged. Furthermore, the main body may be partially openable to facilitate a maintenance operation such as part exchange and inspection.

However, the modifications for enabling parts to be exchanged and the main body to be partially opened might involve an increase in the number of parts, and thus have not been able to be easily accomplished in terms of downsizing of the printer.

In view of this, an object of the present invention is to provide a printer enabling parts to be exchanged without increasing the number of parts.

An aspect of the present invention provides a printer including a casing, a detachable unit provided to the casing, the detachable unit being configured to be detachable from the casing, an adjacent member provided adjacent to the detachable unit, and an engagement member attached to the adjacent member, the engagement member being configured to be changeable between an engagement position with which the adjacent member is engaged with the casing and a non-engagement position with which the adjacent member is removed from the casing. The engagement member engages the detachable unit to the casing together with the adjacent member, at the engagement position.

With an aspect of the present invention, a printer can have parts exchangeable without increasing the number of parts.

DESCRIPTION OF EMBODIMENTS

A printer 100 according to an embodiment of the present invention will be described below with reference to the drawings.

The printer 100 is a thermal printer that performs printing by heating an ink ribbon R and transferring ink on the ink ribbon R onto a print medium M. The print medium M is a continuous label body with a plurality of labels continuously temporarily attached on a strip-shaped liner sheet.

Figure 1:
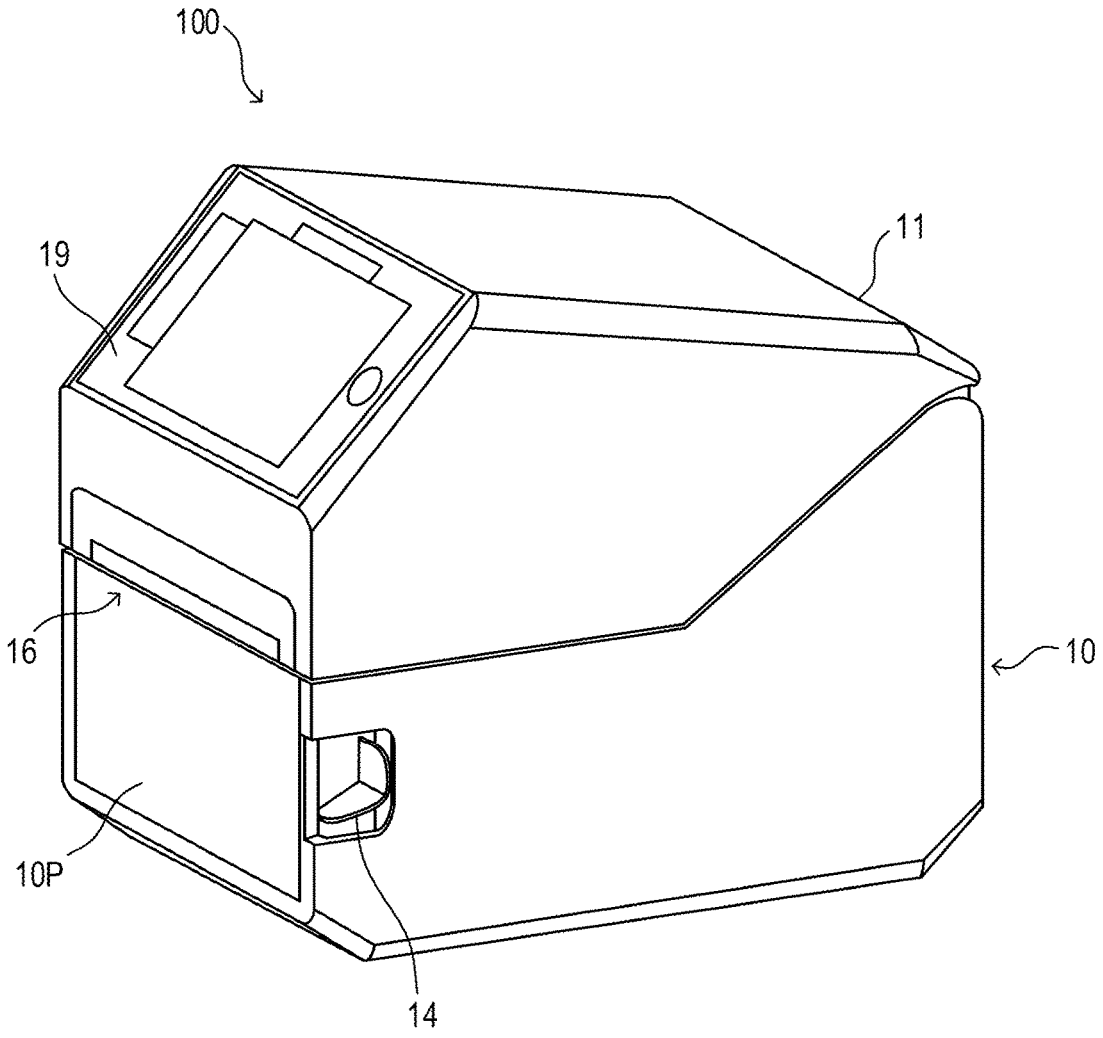
FIG. 1 is a perspective view of a printer 100 according to an embodiment of the present invention.
Figure 2:
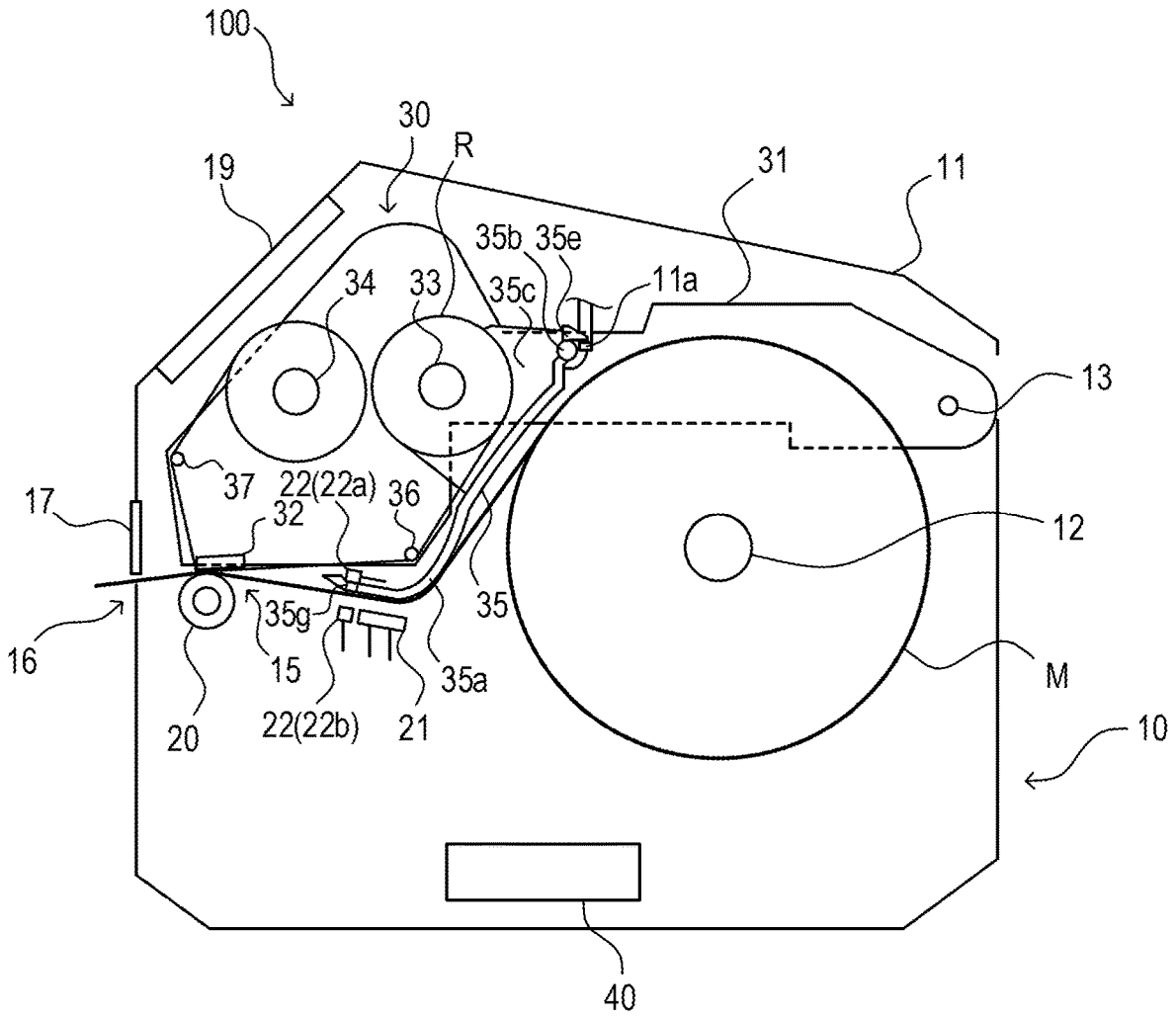
FIG. 2 is a schematic view illustrating a configuration of the printer 100 according to the embodiment of the present invention.

As illustrated in FIG. 1 and FIG. 2, the printer 100 includes a casing 10 and a cover 11 that covers an opening of the casing 10. This casing 10 includes a part of an internal structure of the main body of the printer 100.

As illustrated in FIG. 2, the print medium M is rolled to be in a rolled form to be held by a medium supplying shaft 12. The print medium M may also be a liner less label, or a fanfold type medium.

The cover 11 is pivotally supported by a supporting shaft 13, provided to the casing 10, so that an end portion on one end side can turn. The cover 11 can pivot about the supporting shaft 13 to open and close the opening of the casing 10 to switch between an open state and a closed state.

The casing 10 is provided with a lock mechanism (not illustrated) that maintains the cover 11 in the closed state. The lock mechanism is released by operating a lever 14 illustrated in FIG. 1.

As illustrated in FIG. 1, the casing 10 includes a panel unit 10P. The panel unit 10P is detachably attached to the casing 10. Thus, the panel unit 10P serves as a detachable unit according to the present embodiment.

An ejecting port 16, through which the print medium M after the printing by a printing unit 15 in FIG. 2 is ejected, is formed between an end portion of the cover 11 on the other end side and the casing 10.

A cutter 17, serving as a cutting unit, is attached to the cover 11 according to the present embodiment to face the ejecting port 16. Thus, the print medium M after the printing, ejected from the ejecting port 16, can be cut. Various other units can be attached, in place of the cutter 17, to the cover 11. An example of the other units includes a peeling mechanism that peels a release sheet, if the print medium M includes an adhesive surface on which an adhesive layer is formed and the release sheet covering the adhesive surface.

The cover 11 is provided with an operation unit 19 used for operating the printer 100. The operation unit 19 includes various operation buttons, a display, a near field communication module, a light emitting diode (LED), and the like. The display may be a touch panel.

The printer 100 incorporates a printing unit 30 for performing printing on the print medium M, a controller 40 that controls an operation of the printer 100, and the like.

The printing unit 30 includes a main body part 31 with one end pivotally supported by the supporting shaft 13 and a thermal head 32 attached to the main body part 31.

The thermal head 32 and a platen roller 20, which is provided to the casing 10, serves as the printing unit 15 that performs printing on the print medium M. The platen roller 20 is provided at a position, in the casing 10, adjacent to the panel unit 10P serving as the detachable unit. Thus, in the present embodiment, the platen roller 20 serves as an adjacent member provided adjacent to the detachable unit.

The printing unit 30 includes a ribbon supplying shaft 33 that holds the ink ribbon R, in a rolled form, to be supplied to the printing unit 15, a ribbon roll up shaft 34 that rolls up a used part of the ink ribbon R, a partitioning member 35 serving as a partition between the ink ribbon R and the print medium M, a guide shaft 36 that defines a conveyance path of the ink ribbon R from the ribbon supplying shaft 33 to the printing unit 15, and a guide shaft 37 that defines a conveyance path of the ink ribbon R from the printing unit 15 to the ribbon roll up shaft 34. The ribbon supplying shaft 33 is detachably attached to the partitioning member 35. The ink ribbon R according to the present embodiment is an outside wound ink ribbon with a surface coated with ink facing the outer side.

The print medium M is supplied from the medium supporting shaft 12 to the printing unit 15, and is nipped between the thermal head 32, serving as a print head, and the platen roller 20 together with the ink ribbon R.

When a heating element of the thermal head 32 is energized with the print medium M and the ink ribbon R nipped between the thermal head 32 and the platen roller 20, the printing on the print medium M is performed with the ink on the ink ribbon R transferred onto the print medium M due to the heat from the heating element.

When a platen driving roller (not illustrated) rotates the platen roller 20 in a normal direction, the print medium M and the ink ribbon R are conveyed toward a downstream side in the conveyance direction so that the print medium M is ejected to the outside of the printer 100 through the ejecting port 16.

As illustrated in FIG. 2, the printer 100 includes a reflection sensor 21. The reflection sensor 21 is a sensor that detects matching marks printed in advance on a surface opposite to the printed surface of the print medium M at a predetermined interval. Thus, the position of the print medium M in the conveyance direction can be detected.

The printer 100 further includes a transmission optical sensor 22 that detects the position of the print medium M in the conveyance direction.

The transmission optical sensor 22 includes a light emitting unit 22*a* serving as a light emitter that emits predetermined light and a light receiving unit 22*b* that receives the light emitted from the light emitting unit 22*a* and outputs an electrical signal corresponding to the intensity of the light received.

For example, if the print medium M is a continuous label member formed with a plurality of labels temporarily attached on a strip shaped liner sheet at a predetermined interval, there is only a portion of the liner sheet between two adjacent labels.

Since the amount of transmission of light emitted from the light emitting unit 22*a* differs between the label portion and the liner sheet only portion, the intensity of light received by the light receiving portion 22*b* changes. Thereby, the transmission optical sensor 22 can detect the position of the print medium M in the transport direction.

As illustrated in FIG. 2, the partitioning member 35 includes a base portion 35*a*, a shaft portion 35*b* provided on one end side of the base portion 35*a*, a supporting portion 35*c* that supports the ribbon supplying shaft 33 to be in parallel with and rotatable relative to the shaft portion 35*b*, and an engaging portion 35*e* that is formed at a center part of the shaft portion 35*b*.

The partitioning member 35 is pivotally supported on the main body part 31 by the shaft portion 35*b*.

As illustrated in FIG. 2, the engaging portion 35*e* is configured to engage with an engaging target portion 11*a* provided to the cover 11. When the partitioning member 35 is at a position (closed position) at which the engaging portion 35*e* engages with the engaging target portion 11, the ribbon supplying shaft 33 is accommodated in the main body part 31. Thus, the ribbon supplying shaft 33 is at a ribbon supplying position for supplying the ink ribbon R to the printing unit 15.

In the present embodiment, as illustrated in FIG. 2, the light emitting unit 22*a* is provided on the side of the base portion 35*a* opposite to the side where the conveyance path of the print medium M is provided, that is, on the upper surface side of the base portion 35*a*. A through hole 35*g* through which the light emitted from the light emitting unit 22*a* passes is formed in the base portion 35*a*. On the other hand, the light receiving unit 22*b* is provided on the side of the conveyance path opposite to the side on which the cover 11 is provided, that is, the side on which the casing 10 is provided.

The printer 100 performs the printing in a state where the cover 11 is closed and the engaging portion 35*e* of the partitioning member 35 is engaged with the engaging target portion 11*a* of the cover 11.

Thus, when the cover 11 shifts from the closed state to the open state, the printing unit 30 swings integrally with the cover 11.

Thus, the print medium M can be set to the printer 100 and maintenance for various parts in the casing 10 can be performed.

[Description on Attachment Portion for Platen Roller]

Next, a portion of the printer 100 according to the present embodiment for attaching the platen roller 20 will be described.

Figure 3:
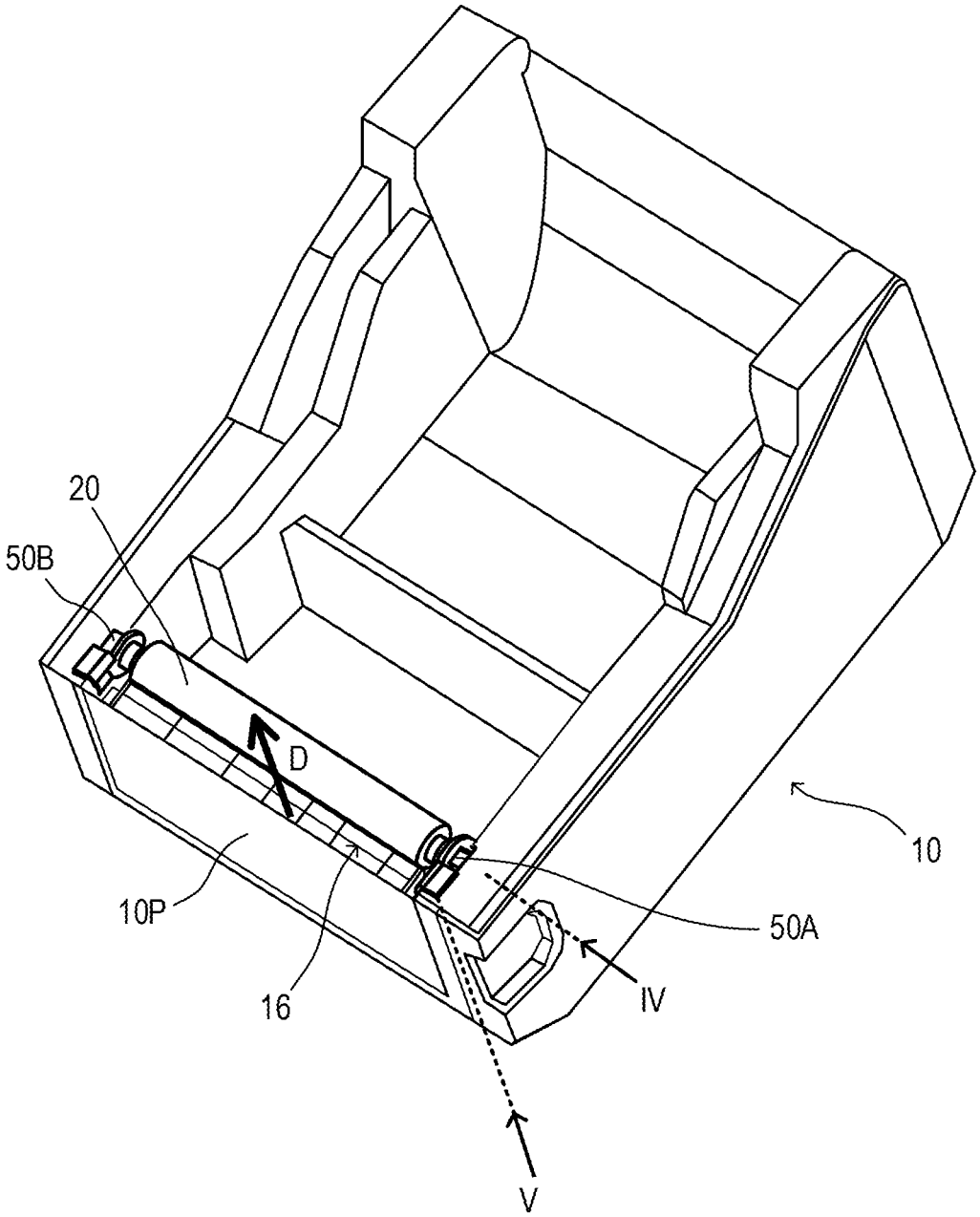
FIG. 3 is a schematic perspective view illustrating an attachment portion for attaching a platen roller 20 to a casing 10 of the printer 100 according to the embodiment of the present invention.

FIG. 3 is a schematic perspective view illustrating the portion of the printer 100 according to the embodiment of the present invention, for attaching the platen roller 20 to the casing 10. In FIG. 3, the internal structures of the platen roller 20 and the cover 11 as well as the printing unit 30 and the printer 100 are omitted.

The panel unit 10P detachably attached to the casing 10 is provided adjacent to the platen roller 20. In the present embodiment, the panel unit 10P serving as the detachable unit is arranged on the downstream side than the platen roller 20 in the conveyance direction of the print medium M.

Although not elaborated in the figure, a latching claw is provided in a lower portion of the panel unit 10P. The lower portion of the panel unit 10 *p* is positioned with respect to the casing 10 by inserting the locking claws into the locking holes formed in the casing 10.

Thus, when the panel unit 10P moves in a detachment direction D illustrated in FIG. 3, the latching claw is detached from the latching hole, whereby the panel unit 10P is removed from the casing 10.

The panel unit 10P has an upper portion engaged with the casing 10 by means of engagement members 50A and 50B described below.

The printer 100 includes the engagement members 50A and 50B attached to the platen roller 20. The engagement members 50A and 50B are respectively provided to both ends of the shaft of the platen roller 20. The platen roller 20 is attached to the casing 10 through engagement members 50A and 50B.

The engagement members 50A and 50B can be changed between an engagement position with which the platen roller 20 is rotatably engaged with the casing 10, and a non-engagement position (hereinafter, referred to as a detached position) with which the platen roller 20 is removed from the casing 10. With the engagement position, the panel unit 10P is engaged with the printer 100 together with the platen roller 20.

DESCRIPTION ON ENGAGEMENT MEMBER

Figure 4:
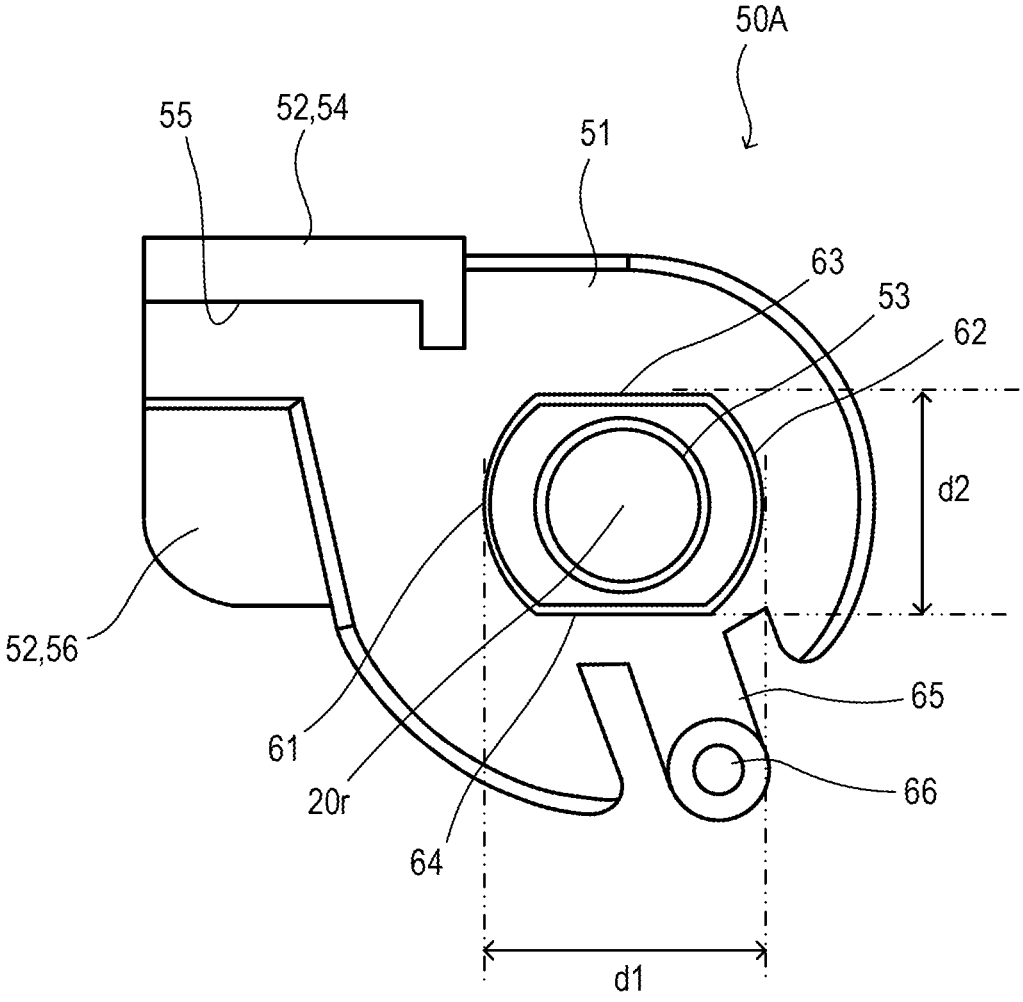
FIG. 4 is a plan view of an engagement member 50A of the printer 100 as viewed in a direction indicated by an arrow IV in FIG. 3.
Figure 5:
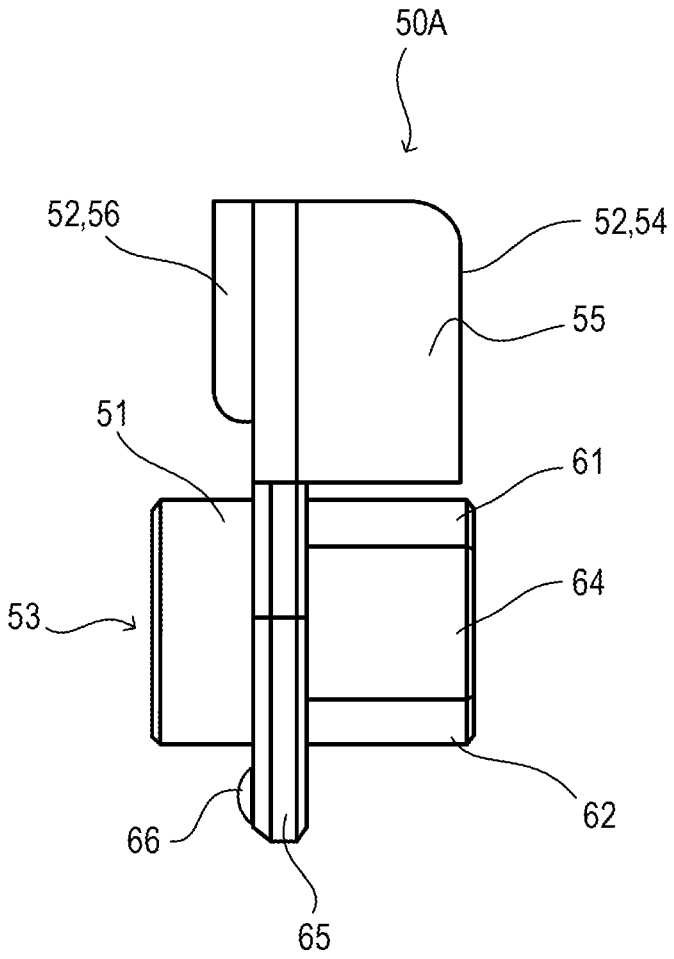
FIG. 5 is a plan view of the engagement member 50A of the printer 100 as viewed in a direction indicated by an arrow V in FIG. 3.

The engagement member 50A will be described in detail below. FIG. 4 is a plan view of the engagement member 50A of the printer 100 as viewed in a direction indicated by an arrow IV in FIG. 3. FIG. 5 is a plan view of the engagement member 50A of the printer 100 as viewed in a direction indicated by an arrow V in FIG. 3.

The engagement member 50A includes an attachment portion 51 for the attachment to the casing 10 and a protruding portion 52 protruding from the attachment portion 51.

An insertion hole 53 into which the shaft 20*r* of the platen roller 20 is rotatably inserted is formed in the attachment portion 51. The attachment portion 51 can be detachably attached to an attachment target portion 70 provided to the casing 10 described later.

A protruding direction of the protruding portion 52 intersects the shaft 20*r* of the platen roller 20 in a state where the shaft 20*r* of the platen roller 20 is inserted into the insertion hole 53 of the attachment portion 51. The protruding portion 52 thus formed is at a position for restricting the movement of the panel unit 10P in the detaching direction D, when the engagement member 50A is at the engagement position.

The protruding portion 52 includes a first protruding portion 54. The first protruding portion 54 includes a contact surface 55 that extends in a direction intersecting with the protruding direction of the protruding portion 52, that is, in a direction of the shaft 20*r* of the platen roller 20.

In the present embodiment, the first protruding portion 54 is formed to have a length in the direction of the shaft 20*r* of the platen roller 20 shorter than a length of the first protruding portion 54 in a circumference direction of the shaft 20*r* of the platen roller 20.

When the engagement member 50A is at the engagement position, the contact surface 55 of the first protruding portion 54 can be in contact with a contact portion 10D formed on the panel unit 10P.

The protruding portion 52 includes a second protruding portion 56. The second protruding portion 56 is formed to have a plate shape protruding from the attachment portion 51 in a direction intersecting with the shaft 20*r*, and extending along a plane intersecting with the shaft 20*r*.

In the present embodiment, the second protruding portion 56 is formed to have a length in the circumference direction of the shaft 20*r* of the platen roller 20 shorter than a length of the second protruding portion 56 in the direction of the shaft 20*r* of the platen roller 20.

The second protruding portion 56 is in a groove portion 10S formed on the panel unit 10P, when the engagement member 50A is at the engagement position In the present embodiment, the second protruding portion 56 is continuously formed with the first protruding portion 54.

The attachment portion 51 of the engagement member 50A includes a pair of convex surface portions 61 and 62. The convex surface portions 61 and 62 are formed to be at positions symmetrical about the insertion hole 53.

The attachment portion 51 further includes a pair of flat surface portions 63 and 64. The flat surface portions 63 and 64 are continuously formed with the convex surface portions 61 and 62 and between the convex surface portions 61 and 62.

A distance d1 between apices of the convex surface portions 61 and 62 is larger than a distance d2 between the flat surface portions 63 and 64.

The protruding direction of the protruding portion 52 from the attachment portion 51 matches the extending directions of the flat surface portions 63 and 64.

The engagement member 50A further includes a third protruding portion 65. The third protruding portion 65 includes a protruding engaging portion 66. The protrusion engaging portion 66 engages with an unillustrated engaging portion formed in the casing 10 when the engaging member 50A is in the engaging position.

Figure 6:
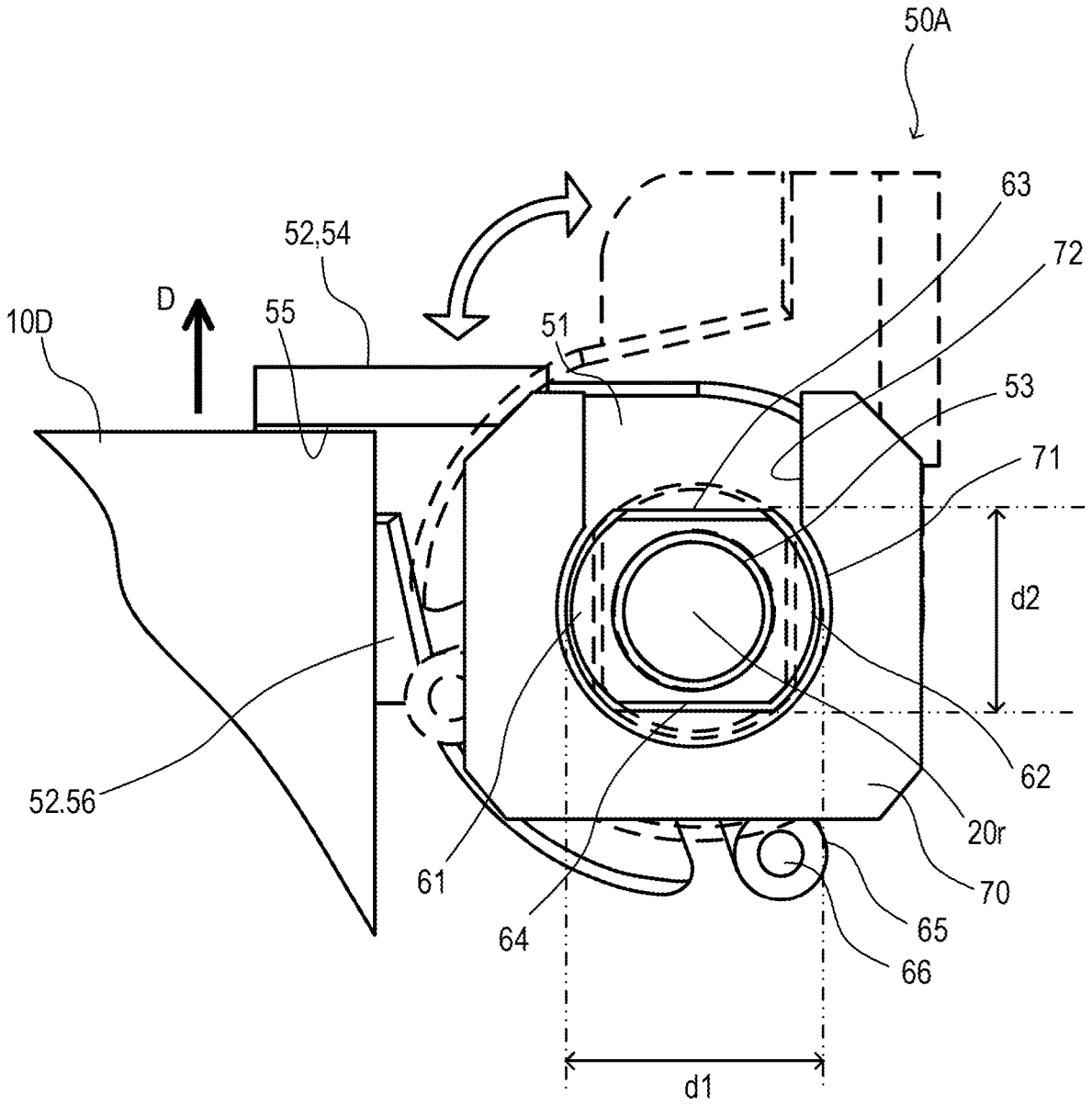
FIG. 6 is a diagram illustrating an operation of the engagement member 50A.
Figure 7:
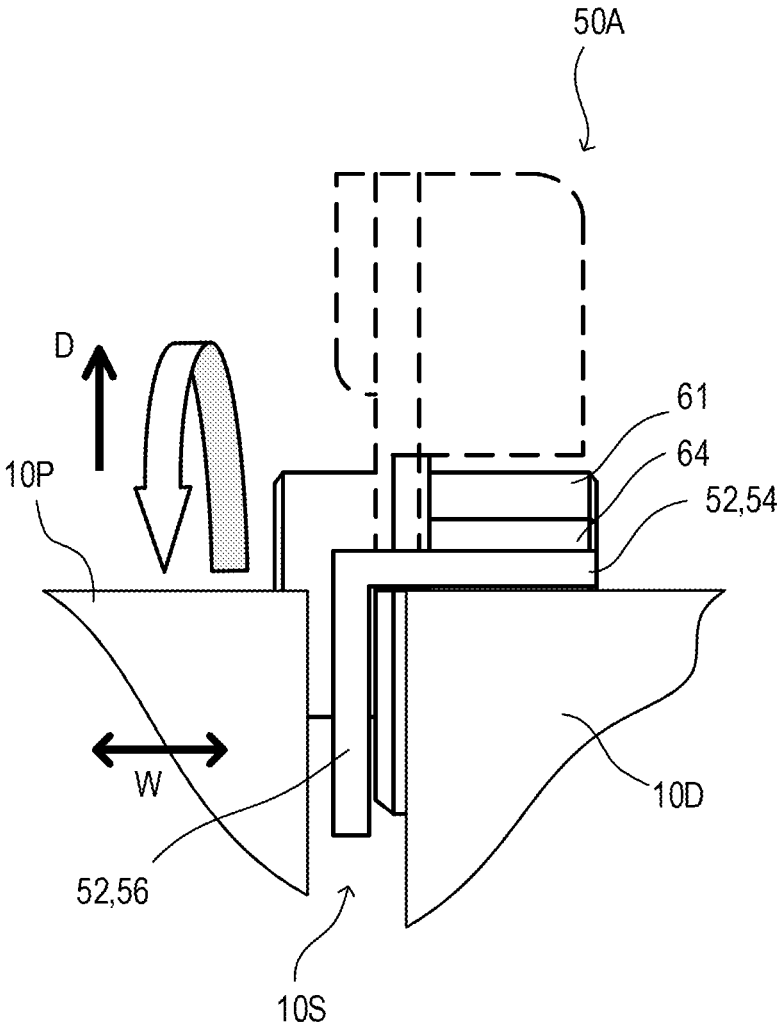
FIG. 7 is a diagram illustrating an operation of the engagement member 50A as viewed from a downstream side in a conveyance direction of a print medium M, at an ejecting port 16 of the printer.

FIG. 6 is a diagram illustrating an operation of the engagement member 50A of the printer 100 as viewed in the direction indicated by the arrow IV in FIG. 3. FIG. 7 is a diagram illustrating an operation of the engagement member 50A as viewed from the downstream side in the conveyance direction of the print medium M at the ejecting port 16 of the printer. Solid lines in FIG. 6 and FIG. 7 indicate the engagement member 50A that has moved to the engagement position, and dashed lines in FIG. 6 and FIG. 7 indicate engagement member 50A that has moved to the detached position.

The casing 10 of the printer 100 includes an attachment target portion 70 to which the attachment portion 51 described above is attached.

The attachment target portion 70 includes an opening 71 and a notch portion 72.

The opening 71 is formed in a size that covers a virtual circle having a diameter that matches the distance d1 between the apexes of the convex surface portions 61 and 62.

The notch 72 is communicated with the opening 71. The notch 72 is formed in such a size that the width d2 between the flat portions 63 and 64 can pass through the notch portion 72.

With the opening 71 and the notch portion 72 formed to have the shapes described above, the attachment portion 51 can be detachably attached to the attachment target portion 70.

More specifically, when the engagement member 50A is at the engagement position as indicated by the solid line in FIG. 6, the convex surface portions 61 and 62 of the attachment portion 51 fit in the opening 71. Thus, the platen roller 20 is fixed to the casing 10.

On the other hand, when the engagement member 50A is at the detached position as indicated by the dashed line in FIG. 6, the width d2 of the attachment portion 51 between the flat surface portions 63 and 64 is at the position corresponding to the notch portion 72 of the attachment target portion 70. In this state, the attachment portion 51 can pass through the notch portion 72 of the attachment target portion 70 to be removed from the opening 71. Thus, the platen roller 20 is removed from the casing 10.

EFFECTS

In the printer 100 according to the present embodiment as described above, the engagement members 50A and 50B for detachably attaching the platen roller 20 to the casing 10 are also used for engaging the panel unit 10P, adjacent to the platen roller 20, to the casing 10.

Thus, the detachable attachment mechanism for the panel unit 10P serving as the detachable unit can be simplified. As a result, the number of parts can be prevented from increasing.

The protruding portion 52 of the engagement member 50A is formed to have the protruding direction, from the attachment portion 51, matching the extending direction of the flat surface portions 63 and 64. The first protruding portion 54 including the contact surface 55, extending in the direction intersecting with the protruding direction of the protruding portion 52, is formed on the protruding portion 52.

Thus, after the attachment portion 51 is inserted into the opening 71 of the attachment target portion 70, in order to fit the convex surface portions 61 and 62 into the opening 71, as the direction of the white arrow shown in FIGS. 6 and 7, the engagement member 50A is rotated from the detached position indicated by the dashed line to the engagement position indicated by the solid line. At this time, the first protruding portion 54 is located in the place which regulates the attachment or detachment direction of contact portion 10D.

Thus, in the printer 100 according to the present embodiment, the engagement members 50A and 50B for detachably attaching the platen roller 20 to the casing 10 can be used for engaging the panel unit 10P adjacent to the platen roller 20.

The engagement member 50A includes the second protruding portion 56 that is formed in a plate form protruding from the attachment portion 51 in the direction intersecting with the shaft 20*r* and extending along a plane intersecting with the shaft 20*r*.

Thus, the second protruding portion 56 enters the groove portion 10S formed on the casing 10, when the engagement member 50A at the detached position as indicated by the dashed line is rotated to be at the engagement position indicated by the solid line so that the attachment portion 51 is positioned at the engagement position.

Thus, the engagement member 50A can restrict the movement of the panel unit 10P in a width direction W of a paper plane.

The engagement member 50A further includes the third protruding portion 65 including the protruding engagement portion 66 engaged with an unillustrated engaging portion formed on the casing 10. This provides an effect of preventing the engagement member 50A from accidentally moving from the engagement position to the detached position.

In the present embodiment, the engagement members 50A and 50B are formed to be mirror symmetrical. Thus, the structure of the engagement member 50A and the operations and effects related to the structure are also applied to the engagement member 50B.

OTHER EMBODIMENTS

The embodiment of the present invention described above is merely one example of the application of the present invention. Thus, there is no intention to limit the technical scope of the present invention to the specific configuration of the embodiment described above.

The positions, the shapes, and the like of the third protruding portion 65 and the protruding engagement portion 66 are not limited to those illustrated in the figures.

The ink ribbon R according to the present embodiment may be an inside wound link ribbon with the surface coated with ink facing the inner side.

In the printer 100 according to the present embodiment, the detachable unit may not be the panel unit 10P that is a part of the casing 10. For example, if the print medium M is a sticker with a separator, the detachable unit may be a unit that provides a function of peeling the separator. Furthermore, the detachable unit may be a unit that provides a function of cutting the continuous print medium M.

In the present embodiment, the panel unit 10P may be latched to the casing 10 with an unillustrated latching portion at a position other than that of the latching claw.

In the present embodiment, the detaching direction of the panel unit 10P is not limited to the detaching direction D illustrated in FIG. 3. For example, the detaching direction of the panel unit 10P may be a direction toward the outer side of the printer 100. Thus, the detaching direction may be a direction toward the downstream side in the conveyance direction of the print medium M at the ejecting port 16.

The present application claims priority to Japanese Patent Application No. 2017-185375 filed on Sep. 26, 2017 to Japan Patent Office, the entire content of which is incorporated herein by reference.

The invention claimed is:

1. A printer comprising:

a casing;

a detachable unit provided to the casing, the detachable unit being configured to be detachable from the casing;

an adjacent member provided adjacent to the detachable unit; and an engagement member attached to the adjacent member, the engagement member being configured to be changeable between an engagement position with which the adjacent member is engaged with the casing and a non-engagement position with which the adjacent member is removed from the casing, wherein the engagement member engages the detachable unit to the casing together with the adjacent member, at the engagement position.

2. The printer according to claim 1, wherein the adjacent member is a platen roller configured to be detachably attached to the casing and configured to convey a print medium being nipped between the platen roller and a print head, and the engagement member is configured to be changeable between an engagement position with which the platen roller is rotatably engaged with the casing and a non-engagement position with which the platen roller is removed from the casing.

3. The printer according to claim 2, wherein the engagement member includes an attachment portion with which the platen roller is attached to the casing, and a protruding portion protruded in a direction intersecting with a shaft of the platen roller, the protruding portion being configured to engage the detachable unit while the engagement member is at the engagement position.

4. The printer according to claim 3, wherein the protruding portion includes a first protruding portion protruded from the attachment portion in a direction intersecting with the shaft, the first protruding portion having a contact surface configured to contact a contact portion formed on the detachable unit while the engagement member is at the engagement position.

5. The printer according to claim 3, wherein the protruding portion includes a second protruding portion protruded from the attachment portion in a direction intersecting with the shaft, the second protruding portion being configured to be in a groove portion formed on the detachable unit while the engagement member is at the engagement position.

6. The printer according to claim 3, wherein an insertion hole through which the shaft of the platen roller is rotatably inserted is formed on the attachment portion, the attachment portion includes a pair of convex surface portions formed at positions symmetrical about the insertion hole and a pair of flat surface portions formed between the convex surface portions and to continue to the convex surface portions, a distance between apices of the convex surface portions is larger than a distance between the flat surface portions, the printer further includes an attachment target portion having:

an opening large enough to encompass a circle with a diameter configured to be same as the distance between the apices of the convex surface portions, and a notch portion configured to be in communication with the opening and configured to be formed to enable a width between the flat surface portions to pass through the notch portion, and the protruding portion protrudes from the attachment portion in a direction along the flat surface portions.

7. The printer according to claim 6, wherein the engagement member includes a third protruding portion configured to engage with the attachment target portion when the engagement member is at the engagement position.

8. The printer according to claim 1, wherein the engagement member rotates to be changeable between the engagement position and the non-engagement position.

9. The printer according to claim 1, wherein the detachable unit is a cutting unit configured to cut the print medium.

10. The printer according to claim 1, wherein the print medium includes an adhesive surface on which an adhesive layer is formed and a release sheet configured to cover the adhesive surface, and the detachable unit is a peeling mechanism configured to peel the release sheet.

11. The printer according to claim 1, wherein the detachable unit is arranged more on a downstream side than the platen roller in a conveyance direction of the print medium.

* * * * *